United States Patent [19]

Hartl

[11] 4,232,855

[45] Nov. 11, 1980

[54] TAP-HOLE CLOSING ARRANGEMENT

[75] Inventor: Johann Hartl, Linz, Austria

[73] Assignee: Voest-Alpine Aktiengesellschaft, Linz, Austria

[21] Appl. No.: 74,882

[22] Filed: Sep. 12, 1979

[30] Foreign Application Priority Data

Oct. 4, 1978 [AT] Austria ..... 7147/78

[51] Int. Cl.[3] ..... C21C 5/48

[52] U.S. Cl. ..... 266/272

[58] Field of Search ..... 266/272, 187, 195

[56] References Cited

U.S. PATENT DOCUMENTS

| | | | |
|---|---|---|---|
| 3,973,761 | 8/1976 | Pelletier | 266/272 |
| 4,007,035 | 2/1977 | Smith | 266/272 |
| 4,079,918 | 3/1978 | Truppe | 266/272 |

*Primary Examiner*—P. D. Rosenberg

*Attorney, Agent, or Firm*—Brumbaugh, Graves, Donohue & Raymond

[57] ABSTRACT

A tap-hole closing arrangement comprises a closure body which is insertable into the tap hole on leaving free an annular gap relative to the tap hole wall and includes a compressed-gas conduit and an outer jacket that tapers towards the mouth of the compressed-gas conduit. For applying this arrangement to big converters and improving its slag-retention effect, the outer jacket is formed by a spherical-calotte-shaped face passing over into a frustroconical face, the height of the truncated cone being at least 1 time and at most 2.5 times the diameter of the mouth-side outlet opening of the compressed-gas conduit, and the aperture angle of the truncated cone amounting to at least 15° and at most 70°.

4 Claims, 2 Drawing Figures

TAP-HOLE CLOSING ARRANGEMENT

According to U.S. Pat. No. 4,079,918 an arrangement for closing the tap hole of a metallurgical vessel is provided in which a closure body insertable into the tap hole on leaving free an annular gap relative to the tap hole wall and containing a compressed-gas conduit is provided, comprising an outer jacket that tapers towards the mouth of the compressed-gas conduit.

Such an arrangement serves for enabling a separation of metal and slag during tapping, wherein the known arrangement is particularly easy to handle and can be applied repeatedly, i.e. even when the lining of the tap hole already has been subject to wear. With the known arrangement, the closure body is designed like a truncated cone on which a cylindrical projection is provided on the side of the mouth. This arrangement has satisfactorily been in operation for some time with small converters. Difficulties occurred when attempts were made of applying this arrangement also to big converters, a rapid wear occurring caused by the substantially greater heat influence of a big converter.

The invention aims at improving the known arrangement in a manner that a utilization with a long durability is ensured also with big converters, wherein furthermore a better slag-retaining effect—according to the higher slag bath height of a big converter—is to be achieved. Also, the production costs of the closure body, which constitutes a wear part, are to be kept as low as possible.

These objects are achieved according to the invention in that the outer jacket of the closure body is formed by a spherical-calotte-shaped face which passes over into a frustroconical face on the side of the mouth, the height of the truncated cone being at least one time and at most 2.5 times the diameter of the mouth-side outlet opening of the compressed-gas conduit and the aperture angle of the truncated cone being at least 15 and at most 70°.

The arrangement is particularly durable, if the closure body is made of grey cast iron.

Figure 1:
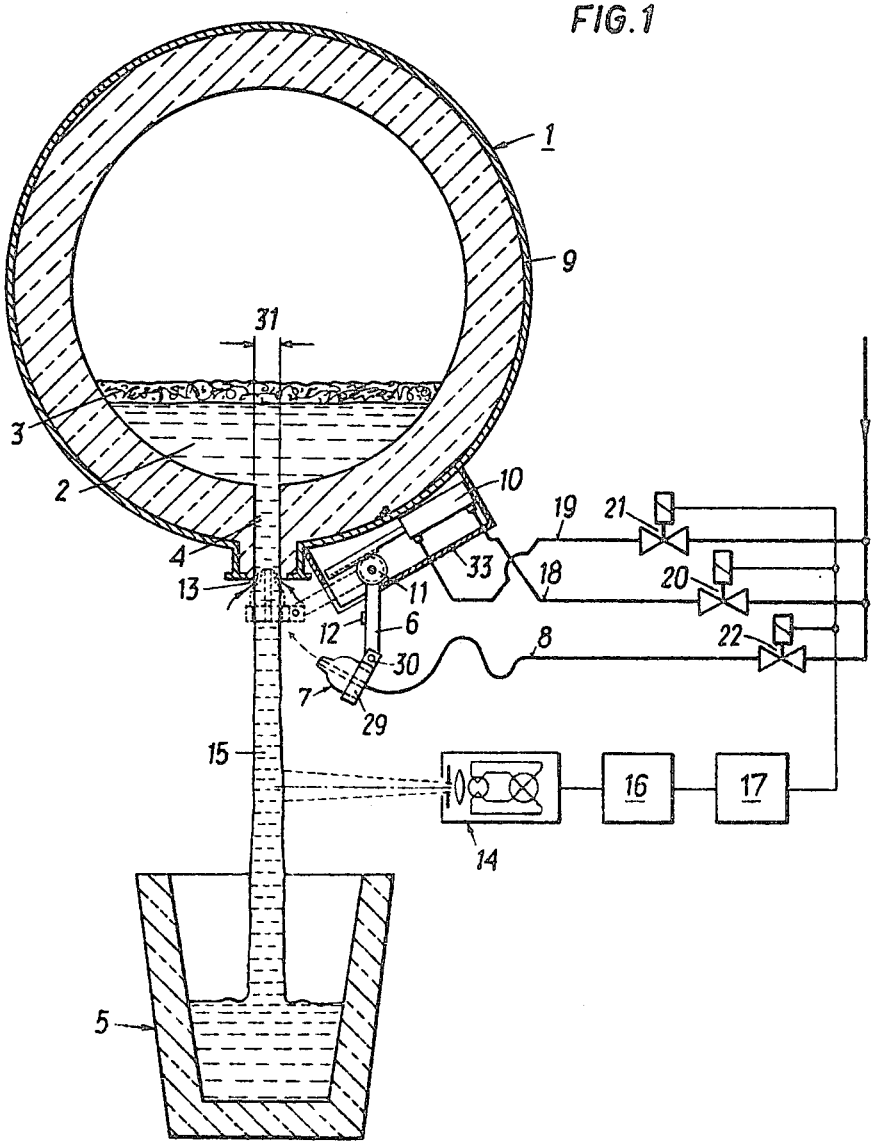
Figure 2:
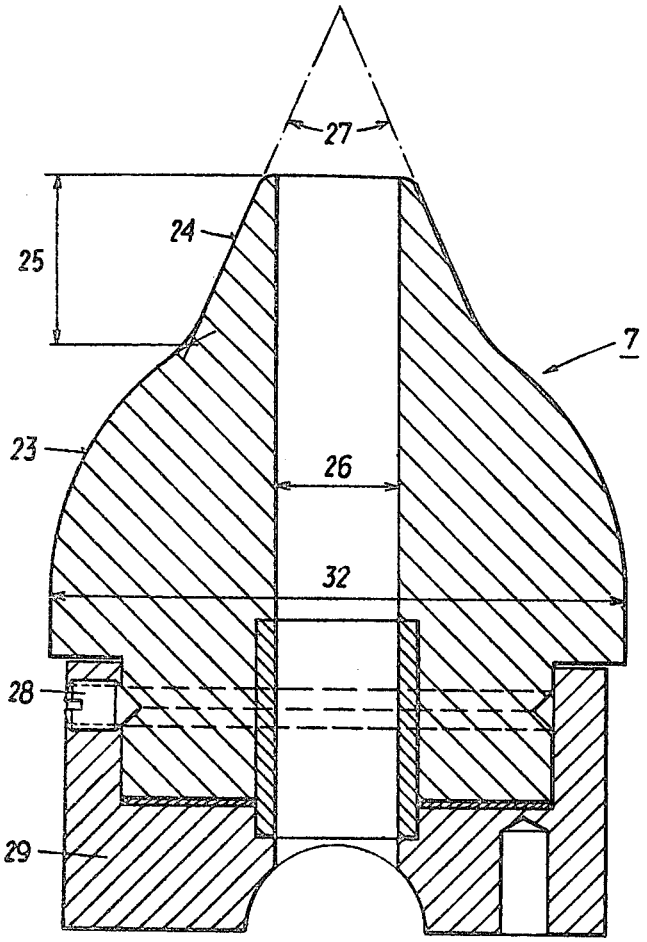

The invention will now be explained in more detail with reference to the accompanying drawings, wherein:

FIG. 1 is a schematically illustrated section through the converter during pouring-off of a steel melt; and FIG. 2 represents a section through the closure body along its axis, on an enlarged scale.

Steel melt 2 is contained in a converter vessel denoted by 1, a slag layer 3 floating thereon. The steel flows through the tap hole 4 into the casting ladle 5 arranged therebelow. For closing the tap hole, a closure body 7 fastened on a pivot arm 6 serves, to which closure body 7 a compressed-air conduit 8 is connected. The pivot arm 6 is hinged to the outer jacket 9 of the refining vessel 1 and is pivotable via a pinion 11 by means of a pressure medium cylinder 10 including a toothed rack and actuatable in both directions, which cylinder is fastened to the outer jacket of the vessel. Stops 12 provided on the pivot arm 6 prevent the closure body from completely closing the tap hole; an annular gap 13 is thus left free.

Closure of the tap hole is effected in the following manner: As soon as the steel has flown off into the casting ladle 5, the slag 3 flows out through the tap hole 4. A ratio pyrometer 14 by which the flowing-out stream 15 is watched gives a pulse at the change from steel to slag, which pulse actuates a relay 17 via an amplifier 16, which relay thereupon transmits an electric signal to the magnetic valves 20, 21, 22 installed in the supply conduits 18, 19, 8 of the pressure medium cylinder 10 and the closure body 7. The magnetic valve 21 is opened, whereby the pressure medium cylinder 10 causes the pivot arm 6 to be brought into the closing position illustrated in FIG. 1 in broken lines. At the same time, the magnetic valve 22 of the supply conduit of the closure body is actuated, whereby the closure body, which in the pivoted-back position shown in FIG. 1 is actuated with a partial pressure of the compressed gas for the purpose of cooling, is actuated with the full pressure of the compressed gas. After reaching the closing position, the compressed gas streaming out causes air to be sucked on through the annular gap 13 according to the injector principle, what is indicated by arrows. Due to the compressed-gas air jet, the slag is forced back into the refining vessel and subsequently can be poured off into a separate slag vessel. As the compressed gas, air under pressure, argon, or nitrogen may for instance be used.

The closure body 7, which is produced of grey cast iron, comprises an outer jacket which is formed by a spherical (calotte-shaped) face 23 that passes over into a frustroconical face 24 on the side of the mouth. The height 25 of the frustroconical face is approximately 1.4 times the diameter 26 of the mouth-side outlet opening of the compressed-gas conduit and the aperture angle 27 of the truncated cone amounts to about 47°.

The diameter 26 amounts to about one third of the diameter 31 of the tap hole 4; the spherical face 23 of the closure body 7 has a diameter 32 which is about 1.5 times the diameter 31 of the tap hole.

By the specially designed shape of the closure body 7, a particularly high durability is reached also with the greatest thermal load. Furthermore, the slag-retaining effect is improved by this shape, i.e. for retaining the slag less compressed air is required with the closure body of the invention. The closure body is also low-priced in its production, provided that it is produced according to the grey iron casting method, wherein an aftertreatment can be renounced. Fastening of the closure body is effected by means of worm screws 28 to the holding device 29, which is displaceably mounted on the arm 6, so that a rapid exchangeability is ensured. An adjustment joint 30 serves for precisely adjusting the closure body 7 relative to the tap hole 4.

For the protection of the pressure medium cylinder, the latter is installed in a heat protection box 33 which is provided with an air shower for cooling (not illustrated). The supply of the compressed-air conduits suitably is effected via the carrying trunnions of the converter vessel (not illustrated).

What I claim is:

1. In a tap-hole closing arrangement provided at a metallurgical vessel for separating metal and slag and of the type including a tap hole wall defining a tap hole, a closure body insertable into said tap hole on leaving free an annular gap relative to said tap hole wall and including a compressed-gas conduit containing a mouth-side outlet opening, an outer jacket surrounding said closure body and tapering towards the mouth of said compressed-gas conduit, the improvement which is characterized in that said outer jacket is formed by a spherical-calotte-shaped face passing over into a frustroconical face on the side of the mouth so as to define a truncated cone, the height of said truncated cone being at least 1 time and at most 2.5 times the diameter of said mouth-side outlet opening of said compressed-gas conduit, and the aperture angle of said truncated cone amounting to at least 15 and at most 70°.

2. A tap-hole closing arrangement as set forth in claim 1, wherein the diameter of said mouth-side outlet opening of said closure body amounts to approximately one third of the diameter of said tap hole.

3. A tap-hole closing arrangement as set forth in claim 1, wherein the diameter of said spherical-calotte-shaped face of said closure body is about 1.5 times the diameter of said tap hole.

4. A tap-hole closing arrangement as set forth in claim 1, 2 or 3, wherein said closure body is made by grey iron casting.

* * * * *